United States Patent [19]

Vitale

[11] Patent Number: 5,048,795

[45] Date of Patent: Sep. 17, 1991

[54] FORCIBLE ACCESS TOOL

[75] Inventor: Martin H. Vitale, Osceola, Iowa

[73] Assignee: Iowa American Fire Fighting Equipment Co., Osceola, Iowa

[21] Appl. No.: 563,087

[22] Filed: Aug. 6, 1990

[51] Int. Cl.[5] ..... B66F 3/24

[52] U.S. Cl. ..... 254/93 R; 29/239

[58] Field of Search ..... 29/239, 275, 252; 254/93 R, 93 H, 133; 269/252; 72/705

[56] References Cited

U.S. PATENT DOCUMENTS

| | | | |
|---|---|---|---|
| 3,081,066 | 3/1963 | Murawski | 254/93 R |
| 3,662,994 | 5/1972 | Johns | 254/93 R |
| 3,946,988 | 3/1976 | Kehren | 254/93 R |
| 4,443,001 | 4/1984 | Haerer | 254/93 R |
| 4,768,753 | 9/1988 | Gates | 254/93 R |

*Primary Examiner*—Robert C. Watson

*Attorney, Agent, or Firm*—Kent A. Herink; Brian J. Laurenzo

[57] ABSTRACT

A forcible access tool for opening a door from its frame. The tool includes a linear actuator, specifically an hydraulic cylinder, comprised of an outer casing and an extensible and retractable axial rod. A stationary jaw member is secured to the outer casing and a movable jaw member is secured to the rod to be movable relative to the stationay jaw member between a fully retracted home position and an extended position. A guide sleeve is secured to the outer casing of the hydraulic cylinder and slidably receives a guide pin which is secured to the movable jaw member. The guide sleeve and pin combination prevents relative angular pivoting or rotation of the jaw members and maintains longitudinal axial alignment of the rod and outer casing during operation of the tool to open a locked or obstructed door. In use, the stationary jaw member is inserted between the closed door and its associated door frame. A hydraulic pump unit is operated to supply pressurized hydraulic fluid to extend the movable jaw relative to the stationary jaw and thereby force open the door.

11 Claims, 3 Drawing Sheets

FORCIBLE ACCESS TOOL

BACKGROUND OF THE INVENTION

The invention relates generally to forcible access tools and, more specifically, to an hydraulically operated, easily portable tool for use by fire fighters, policemen, rescue personnel, and the like, for forcibly separating two structural members, such as opening a door from its frame.

Forcible access tools have wide application in the law enforcement and rescue fields where access behind a closed and locked or obstructed door is frequently required. While a considerable number of tools have been devised for forcibly opening doors, none have had all the features of easy portability, convenience and efficiency of use, and durable and low cost construction.

Known tools having a stationary jaw and an opposed, movable jaw include the one described in U.S. Pat. No. 4,443,001. It utilizes a guide member that encircles the outer casing of an hydraulic cylinder to provide axial longitudinal stability to the movable jaw and a coacting slide bar and channel to prevent relative pivotal movement between the movable jaw and the stationary jaw during use of the tool. Also known is the tool described in U.S. Pat. No. 3,081,066, wherein a plurality of ball bearings mounted to the outer casing of an hydraulic cylinder are received in a corresponding plurality of longitudinal passageways of the axial rod of the cylinder to maintain longitudinal axial alignment of the rod and to prevent relative pivotal movement of the movable jaw relative to the stationary jaw. Each of the foregoing tools uses a remote hydraulic pump unit that is connected to the tool by a flexible hose for providing pressurized hydraulic fluid to operate the tool.

In the present invention, relative axial longitudinal alignment of the movable jaw member is maintained and relative pivotal movement between the movable and stationary jaws is constrained by a separate guide rod and sleeve combination. The guide sleeve also serves as a convenient handle for manipulation of the tool and presents an anvil surface by which the jaws of the tool may be driven between two structural members to be separated by use of a hammer or other impact-type tool.

SUMMARY OF THE INVENTION

The invention consists of a lightweight, easily portable forcible access tool for separating two structural members, such as opening a door that is either locked or obstructed. The forcible access tool includes a linear actuator such as an hydraulic cylinder having an outer casing or sleeve and an axial rod that it extensible and retractable relative to a distal end of the outer casing. A stationary jaw member is secured to the outer casing of the hydraulic cylinder adjacent the distal end portion thereof. A movable jaw member is secured to the distal end portion of the axial rod. When the axial rod is retracted to a home position, the movable jaw member is substantially mated with the stationary jaw member to present an integrated, closed jaw combination for insertion between the two structural members. Also secured to the outer casing of the hydraulic cylinder is a guide sleeve that, in a preferred embodiment, is parallel to the hydraulic cylinder and may be spaced therefrom radially oppositely of the stationary jaw member. A guide member or pin is secured to the movable jaw member and is slidably received inside the guide sleeve. The guide sleeve and pin combination maintain the original angular relationship of the stationary and movable jaw members and the longitudinal axial alignment of the rod inside the outer casing as the axial rod of the hydraulic cylinder is extended and retracted.

In use, the axial rod is moved to its fully retracted or home position and the stationary jaw member is wedged between the door and its casing or jamb. Proper positioning of the tool can be assisted by impact of a hammer or similar tool on an anvil portion of the guide sleeve. An hydraulic pump unit connected to the hydraulic cylinder is operated to supply pressurized hydraulic fluid to the tool. Such fluid will extend the rod to forcibly move the movable jaw member relative to the stationary jaw member and thereby force the two structural members apart.

DETAILED DESCRIPTION OF THE PREFERRED EMBODIMENT

Figures 1, 5:
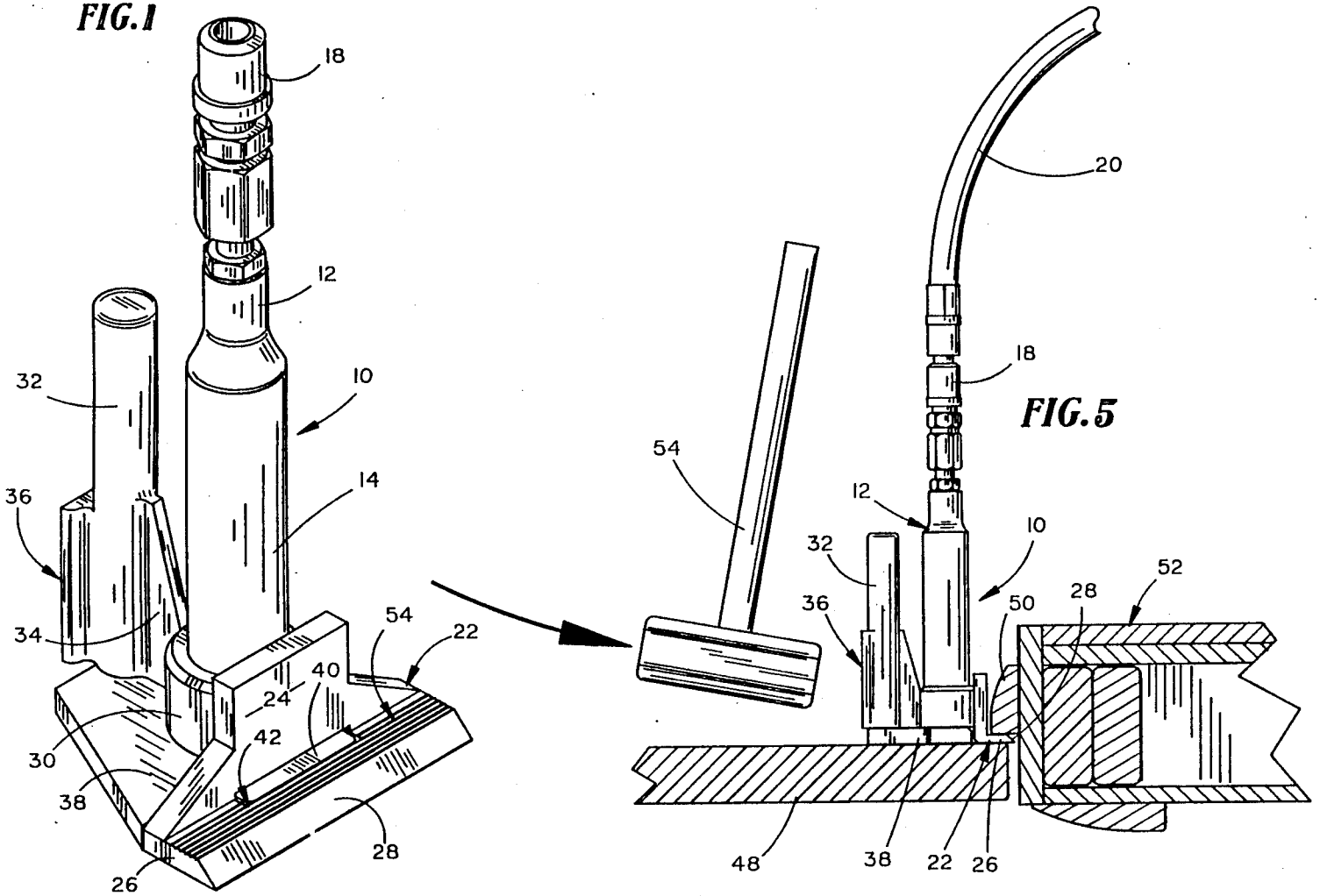
FIG. 1 is an upper perspective view of a forcible access tool of the present invention.
FIG. 5 is a top view of a door and its frame showing the forcible access tool being moved into an operative position by the use of a hammer.
Figure 4:
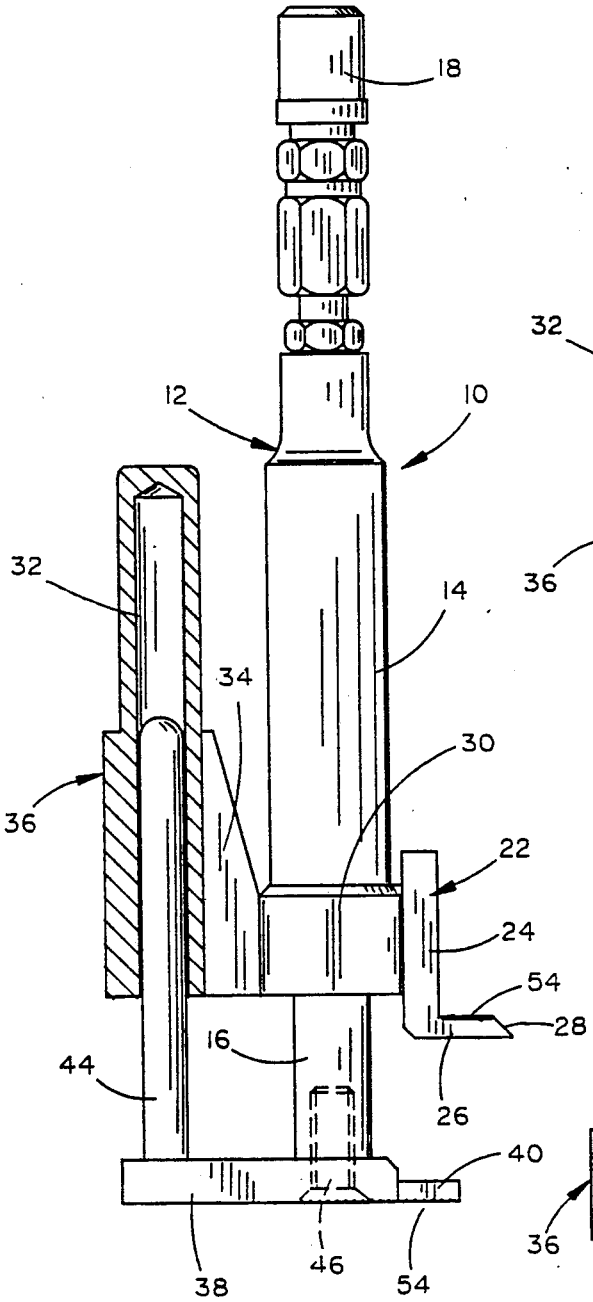
FIG. 4 is a side elevational view of the forcible access tool with a guide sleeve shown in cross section and a screw for releasable attachment of the movable jaw to the axial rod shown in broken line.

Referring to FIG. 1, there is illustrated generally at 10 a forcible access tool. The tool includes an hydraulic cylinder 12 comprised of an outer casing or sleeve 14 and an extensible and retractable axial rod 16 (FIG. 4). The axial rod 16 is spring-biased to its fully retracted position and is extensible outwardly of the distal end of the outer casing 14 upon the delivery of pressurized hydraulic fluid to the hydraulic cylinder 12 by way of the hydraulic fitting 18. Alternatively, the hydraulic cylinder may be a double-acting cylinder that is forcefully movable t both extend and retract the rod. The pressurized hydraulic fluid in the preferred embodiment is supplied by a manually operated hydraulic pump unit (not shown) which is connected to the hydraulic fitting 18 by a flexible hose 20 (FIG. 5). The mating ends of the hydraulic fitting 18 and flexible hose 20 combine to form a quick-connect fitting which can be easily connected and disconnected for ease in transportation and use of the tool 10. Of course, any other type of linear actuator of appropriate construction could be substituted for the hydraulic cylinder 12 with only minor modifications to the tool 10, which would be within the ordinary skill in the art.

Figure 2:
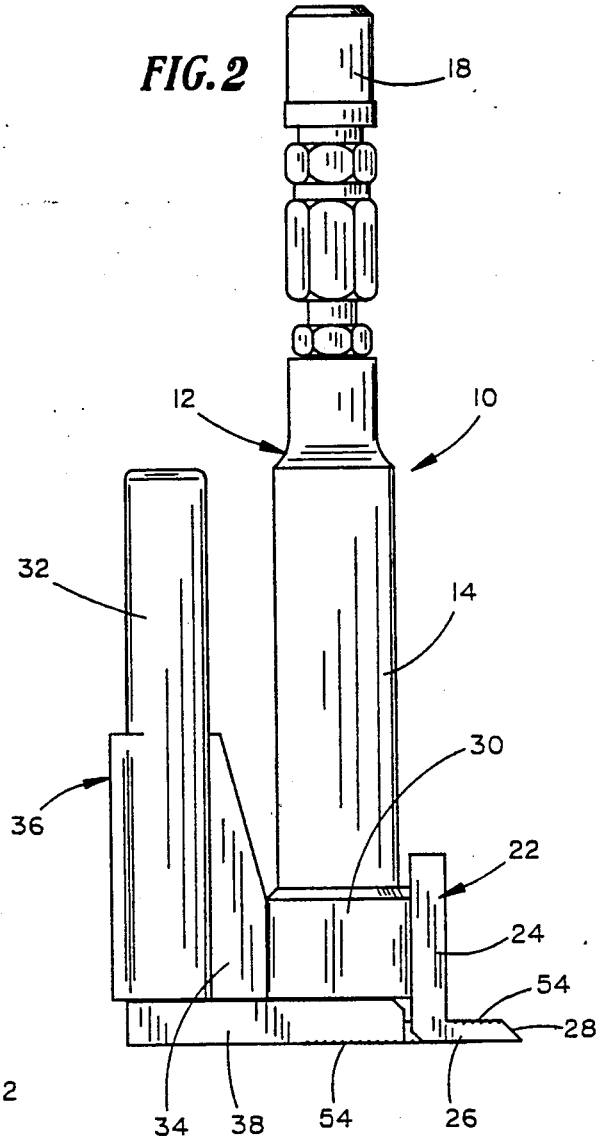
FIG. 2 is a side elevational view of the forcible access tool.

Secured to the distal end of the outer casing 14 is a stationary jaw member 22 which, as best illustrated in FIG. 2, is substantially L-shaped in transverse cross section. The stationary jaw member 22 includes a flat, outwardly facing surface 24 and an outwardly projected tooth section 26 which has a beveled facing edge portion 28. The connection between the stationary jaw member 22 and the outer casing 14 of the hydraulic cylinder 12 is strengthened by a reinforcing ring 30 which encircles the distal end portion of the outer casing 14 and is formed in a single casting with, or may be secured by weldments or the like to, the stationary jaw member 22.

A generally cylindrical guide sleeve 32 is oriented parallel to the hydraulic cylinder 12 and spaced therefrom opposite the stationary jaw member 22. In the preferred embodiment, a flange or web section 34 interconnects the guide sleeve 32 and the reinforcing ring 30, being secured to each by weldments or the like. At the lower or distal portion of the guide sleeve 32 opposite the web section 34 is an anvil face 36. As will be described in more detail below, the anvil face 36 can be impacted by a hammer or similar tool to assist in forcing the tool 10 into an operative position. As the guide sleeve 32 is spaced away from the hydraulic cylinder 12, it is easily graspable and serves as a convenient handle for manipulation of the tool 10. Alternatively, the guide sleeve could be integral with the hydraulic cylinder.

Figure 3:
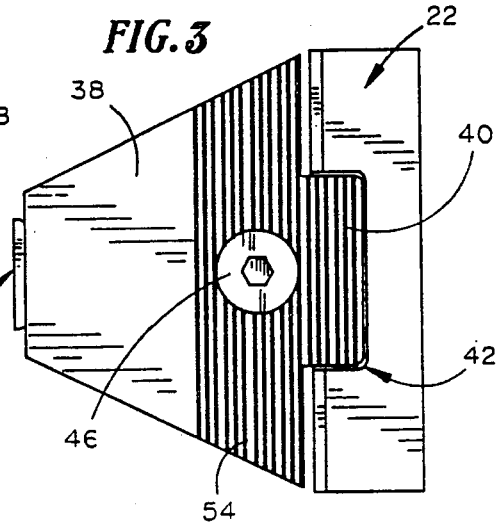
FIG. 3 is a bottom view of the forcible access tool showing the movable and stationary jaw members.

At the distal end of the axial rod 16, a movable jaw member 38 is releasably secured by a bolt 46 (FIG. 3). When the axial rod 16 is in its fully retracted or home position (FIGS. 1 and 2), the lower or distal surfaces of the stationary jaw member 22 and movable jaw member 38 are substantially coplanar, wherein a forwardly projected partial tooth member 40 of the movable jaw 38 is received within a recess or cut-out 42 of the stationary jaw member 22 (FIG. 3).

As best illustrated in FIG. 4, a guide pin 44 projects upwardly from the movable jaw member 38 and is slidably received inside the guide sleeve 32 for relative longitudinal extension and retraction therebetween. Accordingly, as the axial rod 16 is extended and retracted relative to the outer casing 14, the guide pin 44 will be correspondingly extended and retracted relative to the guide sleeve 32. The guide sleeve 32 and guide pin 44 combination thus function to prevent any pivoting or rotation of the axial rod 16 relative to the outer casing 14 so as to maintain the alignment of the stationary jaw member 22 and the movable jaw member 38 during extension and retraction of the axial rod 16. The combination further acts to maintain the relative angular position of the jaw members 22 and 38.

In the preferred embodiment, the guide sleeve 32 and guide pin 44 have circular transverse cross sections. Any coacting cross sections may be used, however, provided only that the guide sleeve and pin combination function to maintain the alignment of the jaw members 22 and 38 during extension of the cylinder in use of the tool. An alternative would be to use an hydraulic cylinder having a rod with a noncircular cross section that would prohibit relative pivotal movement between the rod and the outer casing. Such cylinders are expensive, however, and if a handle was desired, a structure corresponding to the guide sleeve would still be required.

As described briefly above, the tool 10 is used to forcibly separate two structural members. For example, the tool 10 can be used to separate the sliding doors of an elevator, to open a window, to move an escalator to release a trapped rider, or to open a locked or obstructed door. Illustrated in FIG. 5 is a typical door 48 in a closed position therefor against a jamb or casing 50 which is secured to a wall 52. The tool 10 is in its retracted position wherein the movable jaw 38 and the stationary jaw member 22 are substantially coplanar. The bottom or distal surfaces of the jaw members 22 and 38 are placed in contact with the outer surface of the door 48 with the beveled facing edge 28 adjacent the jamb or casing 50. Force is applied to the tool 10 to push the stationary jaw member 22 between the door 48 and the jamb 50. If additional force is required to move the tool 10 into an operative position, an impact tool, such as a hammer 54, may be used to strike the anvil face 36 to drive or wedge the stationary jaw member 22 into position. It is necessary only that a sufficient portion of the forwardly projected tooth section 26 of the stationary jaw member 22 be in contact engagement with the casing or frame 50 so that a suitable purchase is obtained to prevent ejection of the stationary jaw from the jamb during extension of the tool 10 to forcibly open the door 48.

If the tool 10 is positioned such that the surface 24 comes into contact with the frame, it will serve to prevent the tool from pivoting relative to the frame during extension of the cylinder and will thereby act also to prevent premature dislodging of the tool from the door and frame. Even if the surface 24 is not initially in contact with the frame, only limited pivotal movement of the tool will be permitted until the surface 24 does contact the frame.

The tool 10 is connected to the flexible hose 20 of a hydraulic pump unit (not shown) at the hydraulic fitting 18 either prior to positioning to the tool 10 or after the tool 10 has been positioned between the two structural members. Once the tool 10 is in an operative position, the hydraulic pump unit is operated to supply pressurized hydraulic fluid to extend the axial rod 16 thereby moving the movable jaw member 38 away from the stationary jaw member 22 (FIG. 4). Since the stationary jaw member is engaged with the door frame 50 and the movable jaw member 38 is in contact engagement with the door 48, the door 48 will be forced away from the frame 50. The hydraulic pump unit is operated until the door 48 has been cleared of the frame 50 to allow access behind the door 48. If for some reason greater extension of the tool 10 is required to open the door 48 than is available in the stroke of the tool 10, a second opening cycle could be completed wherein a block or other suitable object was placed between the again retracted movable jaw 38 and the partially opened door 48.

Of course, the exact procedure for separating two structural members other than a door and its frame will be dictated by the particular circumstances presented. For example, if opening sliding elevator doors, the jaw members will be inserted between the doors, which insertion may be assisted by a hammer applied to the anvil face. In another application, the jaw members could be inserted between adjacent portions of an escalator and moved apart to separate the two portions to free, for example, a child or other rider who had inadvertantly become caught between the adjacent portions.

The tool may be modified by use of a second hydraulic cylinder in substitution for the guide sleeve wherein its extensible and retractable rod would be secured to the movable jaw member. The second hydraulic cylinder would accomplish the function of the guide sleeve and pin combination and could further be used to apply additional hydraulic force for separating two structural members. The tool may also be modified by making the hydraulic pump unit integral with the tool rather than a separate unit.

Figure 6:
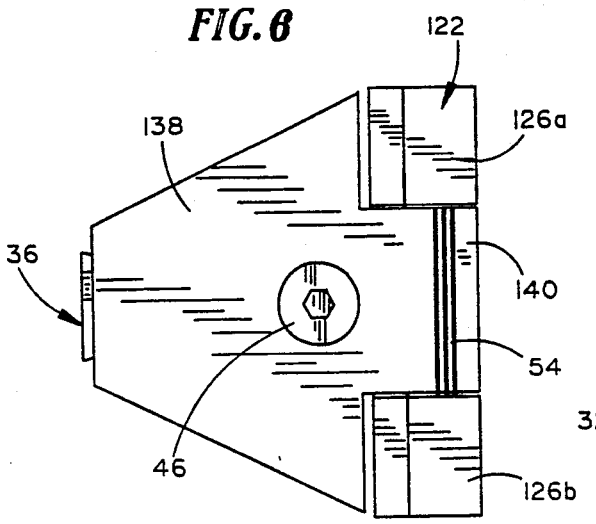
FIG. 6 is a bottom end view of the tool wherein the movable jaw member has a single, central tooth and the stationary jaw member has a pair of spaced teeth.
Figure 8:
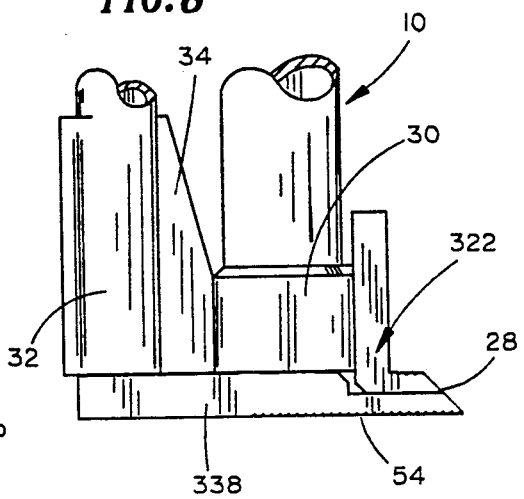
FIG. 8 is an enlarged side elevational view of the stationary and movable jaw members of another modified tool in which both jaw members are of a full, integral width.
Figure 7:
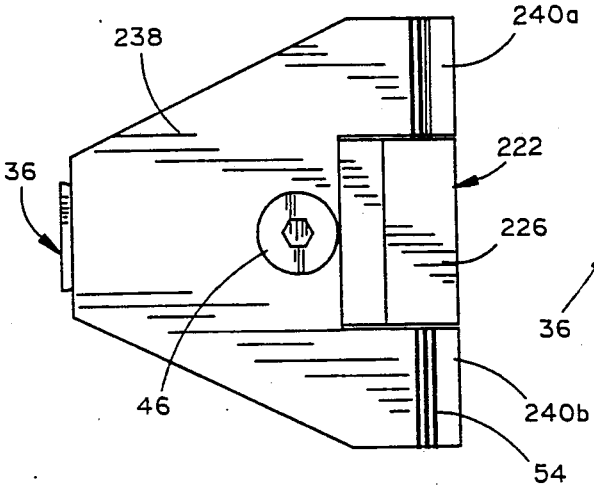
FIG. 7 is a bottom end view of the tool wherein the movable jaw member has a pair of spaced-apart teeth and the stationary jaw member has a single, central tooth.
Figure 9:
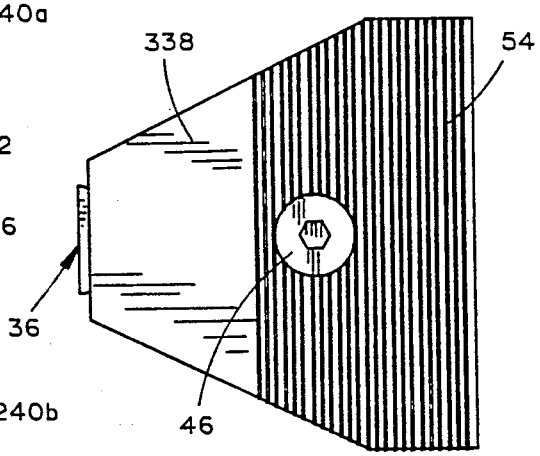
FIG. 9 is a bottom end view of the modification illustrated in FIG. 8.

The stationary and movable jaw members may take a variety of configurations to accommodate different environmental use conditions. For example, as illustrated in FIG. 6, a modified stationary jaw member 122 may be provided in which the forwardly extended section is divided into a pair of tooth members 126*a* and 126*b* at either end thereof. A modified movable jaw member 138 includes a single, central tooth member 140 which intermeshes with the tooth members 126*a* and 126*b*. In a second alternative, as illustrated in FIG. 7, a modified stationary jaw member 222 has a single, central projected tooth member 226 and a modified movable jaw member 238 has two spaced-apart tooth members 240*a* and 240*b*. In the fully retracted position, the tooth members 240*a* and 240*b* would intermesh with the tooth member 226. In a fourth embodiment, illustrated in FIGS. 8 and 9, a stationary jaw member 322 and a movable jaw member 338 both extend across the full width of the tool. Accordingly, each jaw member 322 and 338 is approximately one-half the thickness of the jaw members of the other embodiments. In each of the four alternative embodiments, the operative surfaces of the jaw members may be knurled, illustrated at 54, to improve the grip of the jaw members on the door and door frame so as to prevent or limit slipping of the tool during use.

The tool 10 and its hydraulic pump unit should be light in weight to permit easy portability by law enforcement, fire fighting, or other rescue personnel. At the same time, the jaw members and other structural elements of the tool must be sufficiently strong to resist the large forces that will be supplied by the hydraulic cylinder and required in the separating of structural members, such as reinforced doors. In use of the tool, it has been found convenient to grasp the tool by the guide sleeve 32 above the anvil face 36. The tool can then be struck by a hammer on the anvil face 36 and/or manually held in place while the hydraulic pump unit is operated. One person can easily carry the tool and hydraulic pump unit and can make effective use of the tool through its entire range of operations.

The tool 10 of the preferred embodiment is crafted predominantly of aluminum and stainless steel to acheive both lightness, i.e., a weight of only 18 lbs., and the required strength. The thickness of the jaw members when the tool is in its retracted or home position is less than one-quarter inch. The stroke of the hydraulic cylinder is approximately four and one-half inches, an amount that has been found sufficient either to effect access or to separate the two structural members a sufficient amount to permit the insertion of another device, such as an air bag, to complete the task. A 10,000 psi, nominal, pump unit is used and will fully extend the cylinder in four to five strokes.

While the invention has been described with respect to a preferred embodiment thereof, the invention is not to be so limited thereby, but is to be accorded the full scope of the appended claims.

I claim:

1. A forcible access tool for separating two structural members, comprising:

a. a linear actuator including an outer casing and an axial rod extensible and retractable between a home position and an extended position;

b. a first, stationary jaw member secured to said outer casing;

c. a second, movable jaw member secured to said rod;

d. a stationary alignment sleeve secured to said outer casing and having an axial opening aligned parallel to said axial rod; and e. a free-standing alignment pin secured to said movable jaw member and received for axial sliding movement inside said opening of said alignment sleeve which, in combination with said sleeve, prevents both axial rotation of said movable jaw and maintains axial alignment of said casing and rod, wherein f. said stationary jaw member engages one of the structural members and said movable jaw member engages the other of the structural members to separate the two structural members when said rod is moved to said extended position.

2. A forcible access tool for separating two structural members, comprising:

a. a linear actuator including an outer casing and an axial rod extensible and retractable relative to said casing between a home position and an extended position;

b. a handle member secured to said casing and including an axial opening parallel to said axial rod;

c. an alignment pin mounted to said axial rod and received for axial sliding movement inside said opening of said handle member;

d. a stationary jaw member secured to said casing; and e. a movable jaw member secured to said rod, wherein f. said stationary jaw member engages one of the structural members and said movable jaw member engages the other of said structural members to separate the two structural members upon extension of said rod to said extended position.

3. A tool as defined in claim 2, wherein said alignment pin and handle member comprise a key and a coacting key way combination associated with said rod and said casing.

4. A tool as defined in claim 2, wherein said stationary jaw member has an unbroken leading edge and a recess for receiving said movable jaw member when said rod is in said home position.

5. A tool as defined in claim 2, wherein said stationary jaw member is divided into one or more tooth sections and said movable jaw includes one or more tooth sections that intermesh with said stationary jaw member tooth sections when said rod is in said home position.

6. A tool as defined in claim 1, wherein said alignment sleeve has an anvil portion facing oppositely of said jaw members against which a force is exerted for urging said jaw members between the two structural members.

7. A tool as defined in claim 2, wherein said stationary jaw member and said movable jaw member have knurled engagement surfaces for resisting movement of said jaw members relative to the two structural members during extension of said rod.

8. A tool as defined in claim 2, wherein said handle member has an anvil portion against which a force can be exerted for driving said jaw members between the two structural members.

9. A tool as defined in claim 1, wherein said alignment sleeve is spaced from said outer casing to provide a handle for manipulation of the tool.

10. A tool as defined in claim 2, wherein said jaw members have facing surfaces and wherein said jaw members are in contact engagement across substantially their entire facing surfaces when said rod is in said home position therefor.

11. An hydraulic forcible entry tool for opening a door from its frame, comprising:

a. an hydraulic cylinder including an outer casing and an axial rod extensible and retractable relative to said casing between a home position and an extended position;

b. a first jaw member secured to said outer casing;

c. a second jaw member secured to said rod and which mates with said first jaw member when said rod is in said home position;

d. a guide member secured to said outer casing;

e. a free standing guide pin secured to said second jaw member and received for axial sliding movement inside said guide member which, in combination with said guide member, prevents both axial rotation of said second jaw and maintains axial alignment of said casing and rod, wherein f. said first jaw member engages the door frame and said second jaw member engages said door to open the door upon extension of said rod to said extended position.

* * * * *